United States Patent [19]

Cristescu et al.

[11] Patent Number: 4,709,463

[45] Date of Patent: Dec. 1, 1987

[54] APPARATUS FOR CONNECTING CONDUCTORS TO TERMINALS OF A CROSS-CONNECT CONNECTOR FOR COMMUNICATION LINES

[75] Inventors: Alex G. Cristescu, Montreal; Christopher A. Conea, Roxboro, both of Canada

[73] Assignee: Northern Telecom Limited, Montreal, Canada

[21] Appl. No.: 796,457

[22] Filed: Nov. 8, 1985

[51] Int. Cl.[4] ..... H01R 43/00

[52] U.S. Cl. ..... 29/566.3; 29/749; 29/753

[58] Field of Search ..... 29/566.3, 566.4, 753, 29/751, 749

[56] References Cited

U.S. PATENT DOCUMENTS

| | | | |
|---|---|---|---|
| 3,791,008 | 2/1974 | Dysterhouse | 29/753 X |
| 3,866,293 | 2/1975 | Nijman | 29/566.3 |
| 4,017,954 | 4/1977 | Grubb | 29/751 X |
| 4,080,717 | 3/1978 | Bunnell | 29/566.4 |
| 4,193,187 | 3/1980 | Haller et al. | 29/751 X |
| 4,446,615 | 5/1984 | Talley | 29/753 X |
| 4,566,164 | 1/1986 | Brown et al. | 29/566.3 |

*Primary Examiner*—Robert L. Spruill
*Assistant Examiner*—Steve Katz
*Attorney, Agent, or Firm*—R. J. Austin

[57] ABSTRACT

Apparatus and method for connecting a group of insulated conductors to a cross-connect connector in which the connector is held in an assembly station and a plurality of conductor insertion tools slidably mounted in side-by-side relationship are moved in sequence to insert the conductors sequentially into terminals of the connector. In a preferred arrangement, alternate conductors are inserted into associated terminals sequentially in one direction along the connector and the other conductors are then inserted into their terminals sequentially in the opposite direction along the connector.

11 Claims, 28 Drawing Figures

52
178
110
152
62
40
30
28
16

52
178
10
152
62
40
30
28
16

110
152
52
62
40
30
28
16

52
178
110
62
152
30
40
16
28

APPARATUS FOR CONNECTING CONDUCTORS TO TERMINALS OF A CROSS-CONNECT CONNECTOR FOR COMMUNICATION LINES

This invention relates to the connection of conductors to terminals of a cross-connect connector for communication lines.

In a telecommunications system, different cables are used for different purposes. For instance, customers' premises are provided with an incoming cable from a central office and this cable is referred to as a feeder cable. The conductors of the feeder cable upon arrival at the customers' premises are connected either internally or externally of the premises to the conductors of a distribution cable which are connected in turn to the subscribers' apparatus. The cables are normally connected together with the use of cross-connect connectors each of which comprises a body of dielectric material and has a row of conductor terminals along each side of the connector. Each terminal has opposed electrical conductor portions which cut into insulation of a conductor forced between them thereby causing the conductor portions to electrically contact the conductor. The terminals in one row are interconnected through the dielectric material with terminals in the other row to enable the conductors of the two cables to be interconnected. The cross-connect connectors are mounted for convenience in a wall mounted unit which is a modular construction and is built to carry a plurality (e.g. ten) of the cross-connect connectors.

It is usual for the cross-connect connectors to have fifty terminals along each row. The forming of the connection between conductors and terminals of each row is a time consuming operation. It is conventional practice to connect lengths of conductors to the terminals along one row before insertion of the connector into the wall mounted unit. These lengths of conductors are inserted into the terminals by a manual operation which is tedious as well as time consuming. This manual method which involves the drawing in sequence of conductors across the row of terminals and connecting them to the terminals, this requires operator attention to conductors individually.

The invention provides a method and apparatus for electrically connecting a group of conductors along a row of terminals of a cross-connect connector and in the use of which there may be a substantial increase in the rate of assembly of conductors to connectors.

Accordingly, the present invention provides apparatus for electrically connecting a group of conductors along a row of terminals of a cross-connect connector in an assembly station comprising means for holding the connector in the assembly station; a plurality of conductor insertion tools slidably mounted in side-by-side relationship within an insertion tool carrier for sliding movement towards and away from the holding means; and an insertion tool operating means comprising an operating shaft reciprocable transversely of the direction of sliding movement of the tools, said shaft operably connected to the tools to cause the tools to slidably move in sequence towards and away from the holding means.

The invention also includes a method for electrically connecting a group of insulated conductors along a row of terminals of a cross-connect connector in an assembly station comprising locating the connector in the assembly station; from conductor supplies, feeding a group of insulated conductors together along passlines and through the assembly station to provide lengths of the conductors extending along the passlines downstream from the assembly station while guiding the conductors so that they are aligned with terminals of the row; inserting the upstream ends of the conductor lengths between opposed electrically conductive portions of the terminals in sequence across the passlines of the conductors to enable said terminal portions to cut into insulation surrounding the conductors and make electrical contact with the conductors; and severing said lengths of conductors across the passlines of the conductors to separate the conductor lengths from the conductor supplies upstream from the station thereby leaving the conductor lengths in electrical contact with the terminals.

One embodiment of the invention will now be described, by way of example, with reference to the accompanying drawings, in which.

Figure 2:
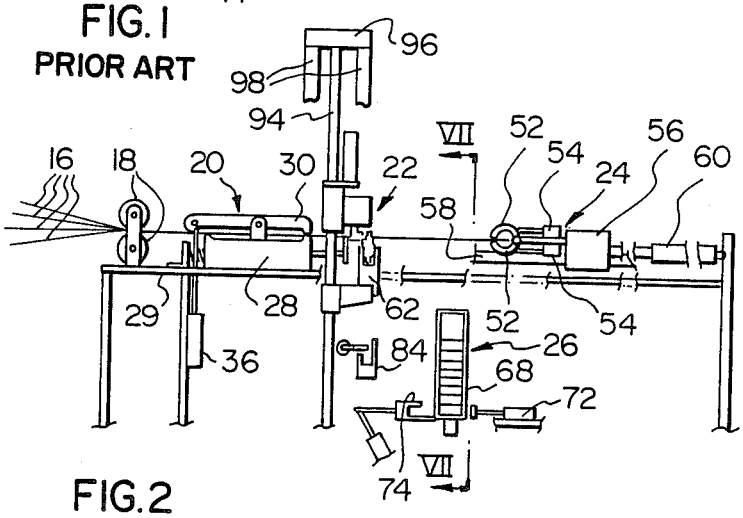
FIG. 2 is a side elevational view of apparatus for electrically connecting a group of conductors to the cross-connect connector with frame parts of the apparatus cut away to show, in general manner, operational parts of the apparatus.
Figure 3:
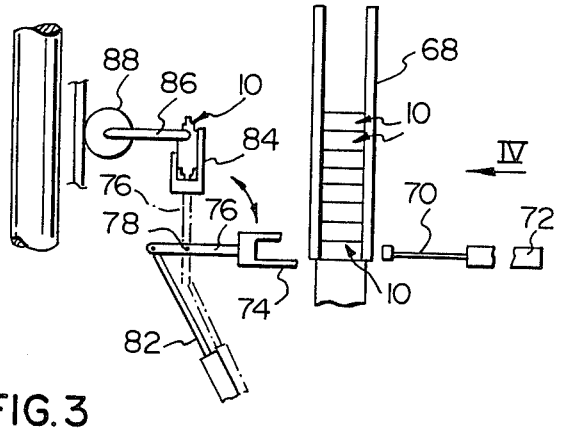
Figure 4:
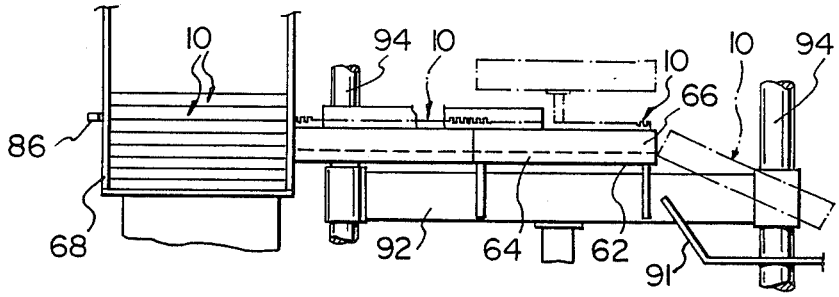
Figure 5:
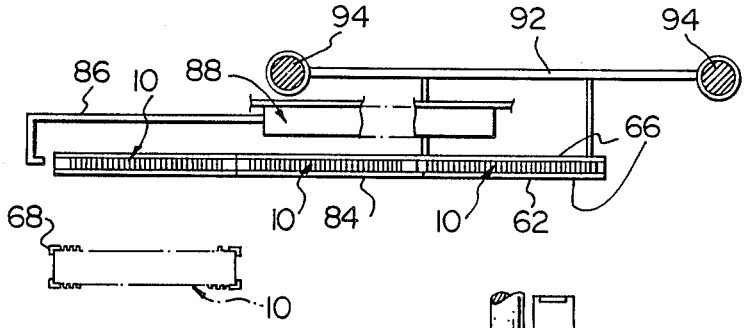
Figure 6:
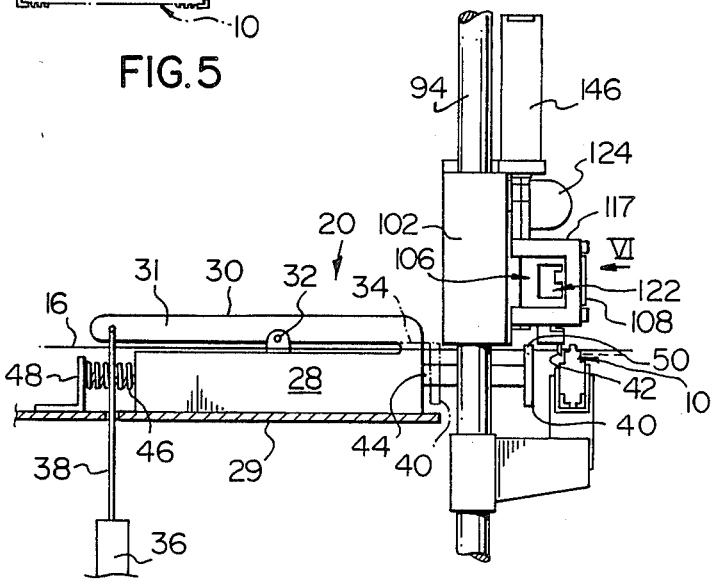
Figure 7:
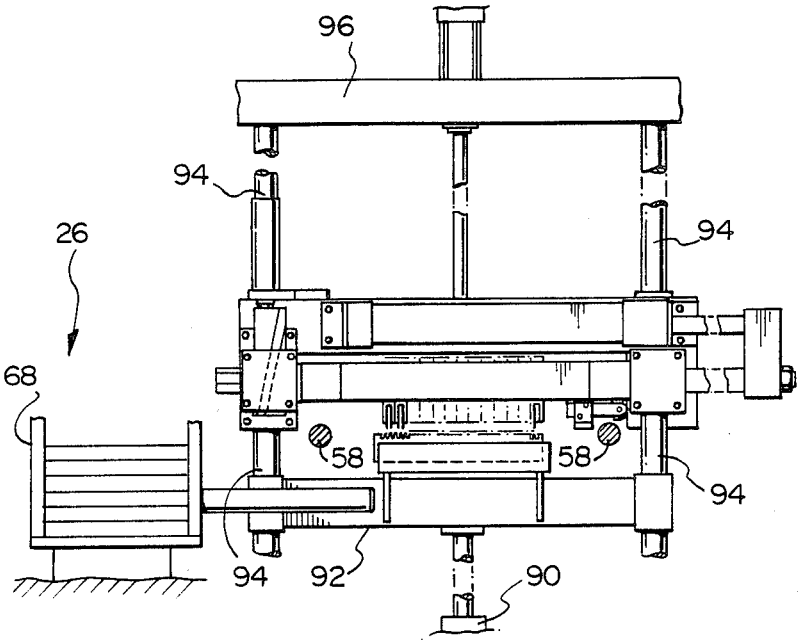
Figure 8:
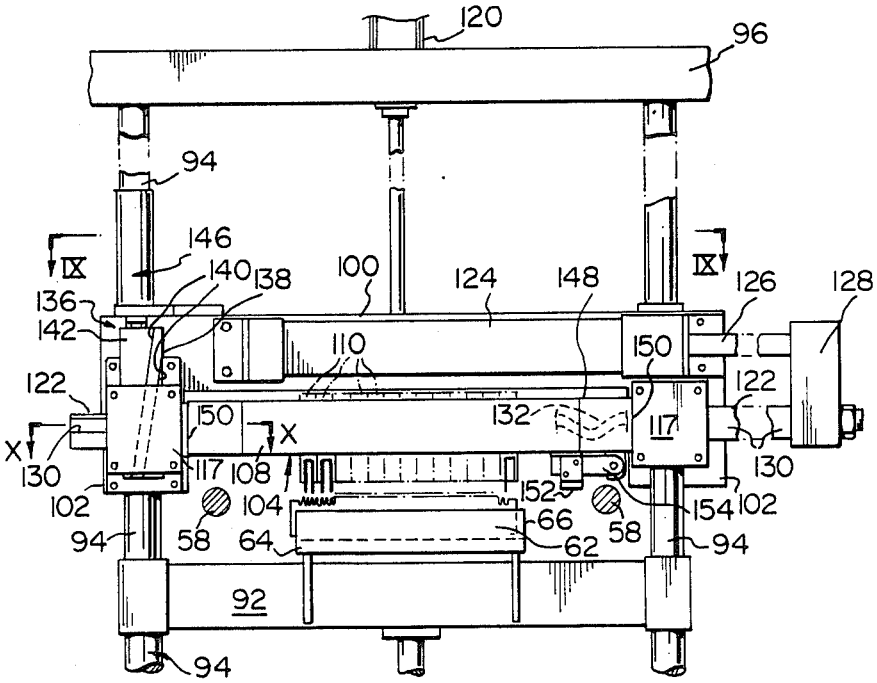
Figure 9:
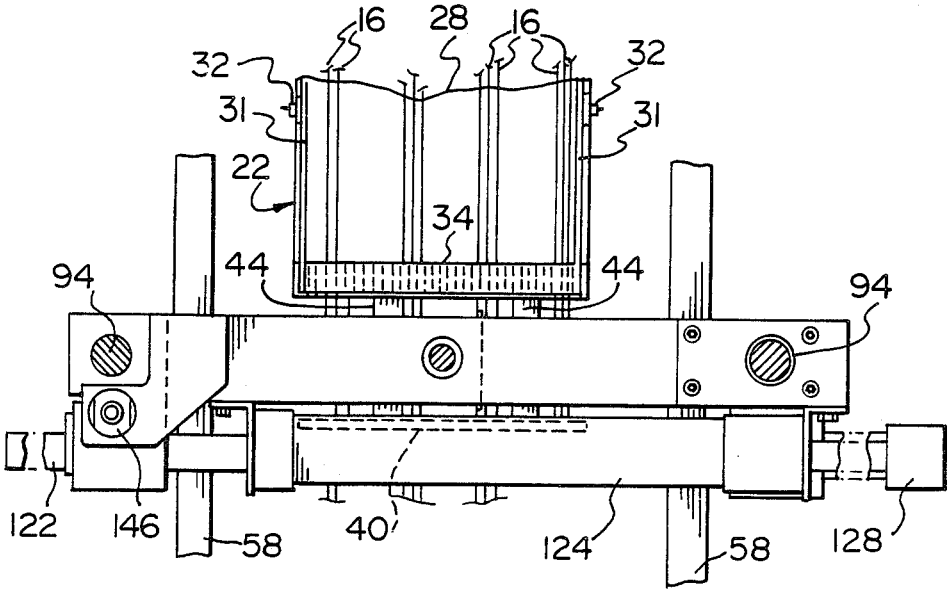
Figure 10:
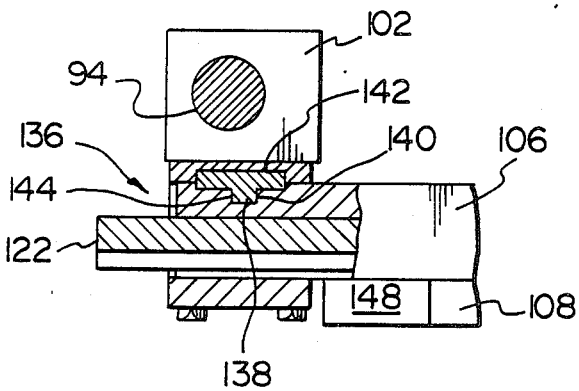
Figure 11:
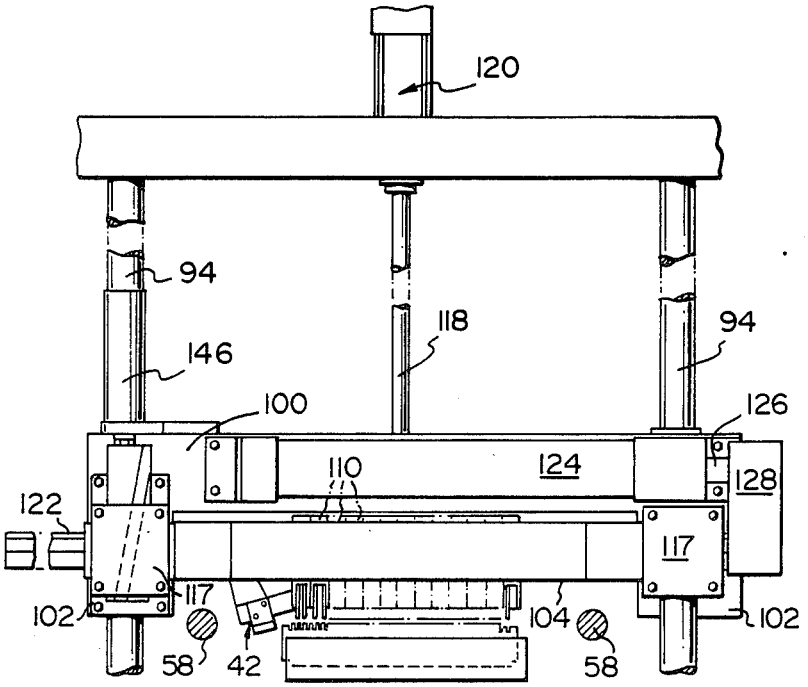
Figure 12:
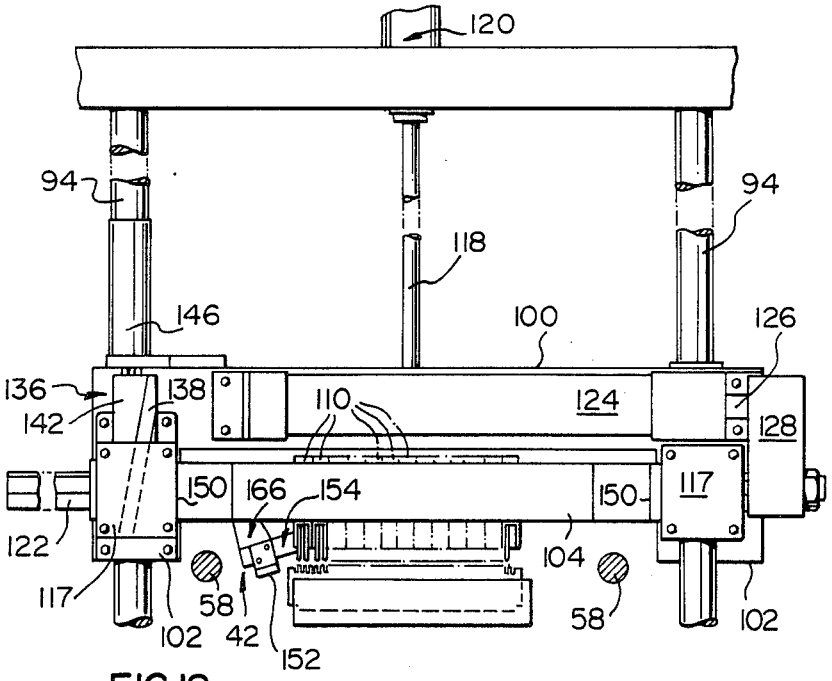
Figure 13:
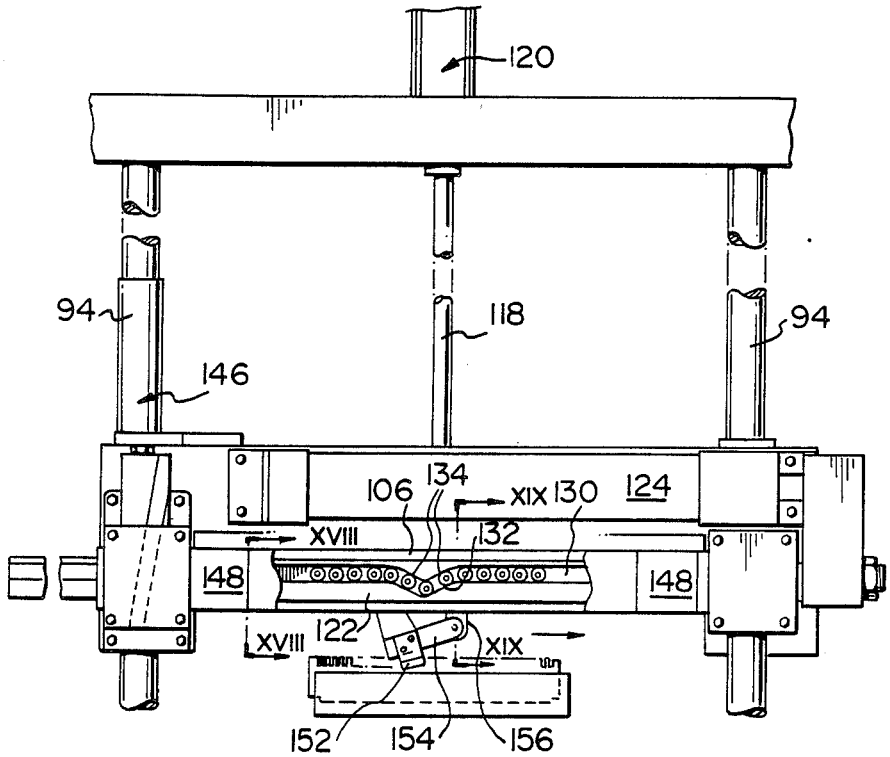
Figure 18:
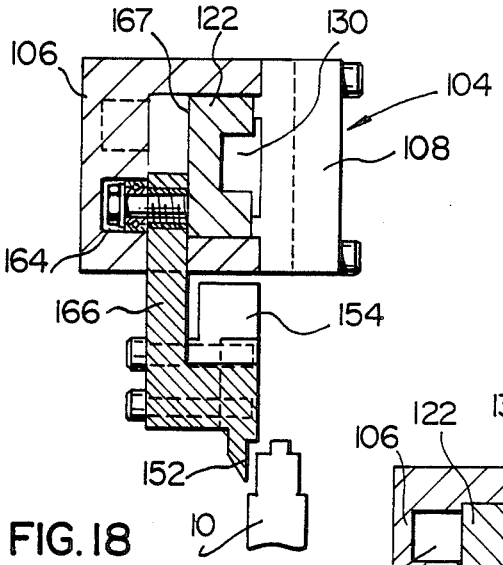
Figure 19:
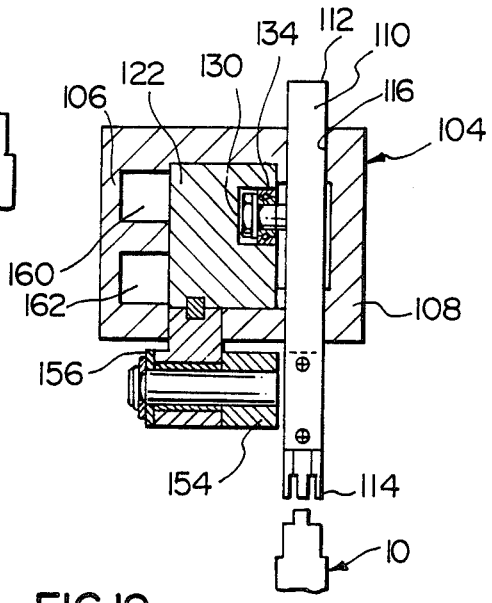
Figure 20:
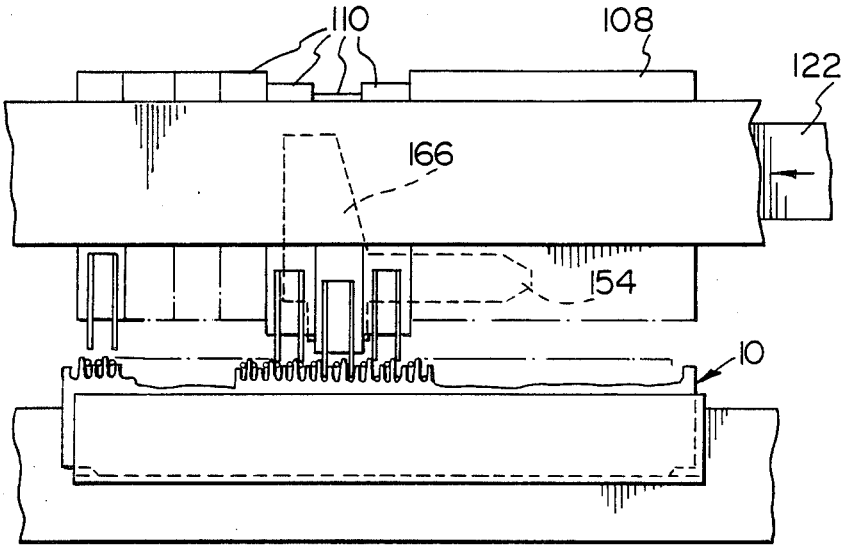
Figure 21:
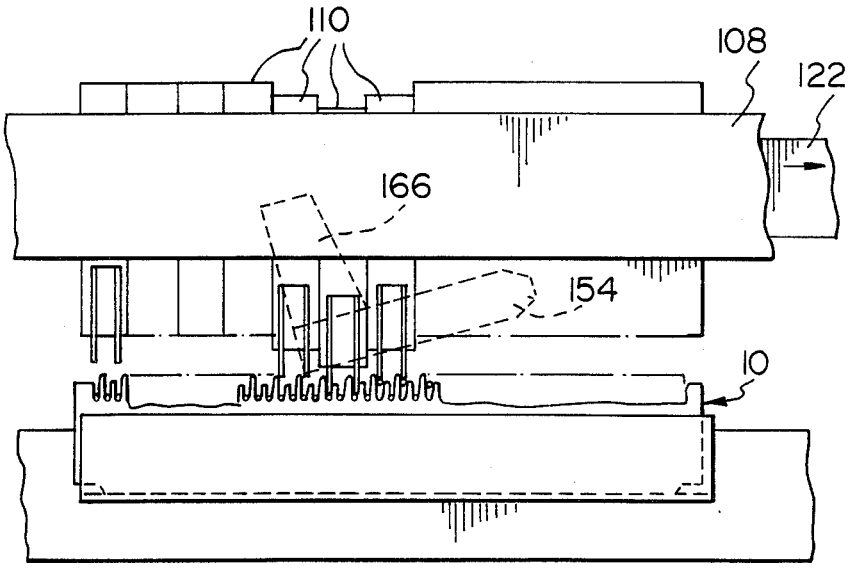

FIG. 3, on a larger scale than FIG. 2, is a side view in the same direction as FIG. 2 and showing a connector loading device;

FIG. 4 1s a view of part of the loading device in the direction of arrow IV in FIG. 3;

FIG. 5 is a view of part of the loading device taken in the direction of arrow V in FIG. 2;

FIG. 6 on the same scale as FIG. 3, is a view in the same direction as FIG. 2, and shows means for inserting conductors into connectors in an assembly station;

FIG. 7 is a cross-sectional view taken along line VII—VII in FIG. 2;

FIG. 8 is a view in the same direction as FIG. 7 and on a larger scale to show in greater detail an insertion tool operating means of the apparatus;

FIGS. 9 and 10 are cross-sectional views through the apparatus taken along lines IX—IX and X—X in FIG. 8;

FIGS. 11 and 12 are views similar to FIG. 8 and showing stages in a conductor insertion cycle;

FIG. 13 is a view similar to FIG. 8 and partly in cross-section to show detail of part of the insertion means;

FIGS. 14 to 17 are views similar to FIG. 8 and partly in cross-section to show movement of a wire cutter during the insertion cycle;

FIGS. 18 and 19 are cross-sectional views taken along lines XVIII—XVIII and XIX—XIX in FIG. 13 and on a larger scale;

FIGS. 20 and 21 are views in the same direction as FIG. 8, on the same scale as FIG. 18 and show operation of the insertion and cutting means in detail; and FIGS. 22 to 28 are diagrammatic side elevational views of main functional parts of the apparatus and showing the stages in its operation.

Figure 1:
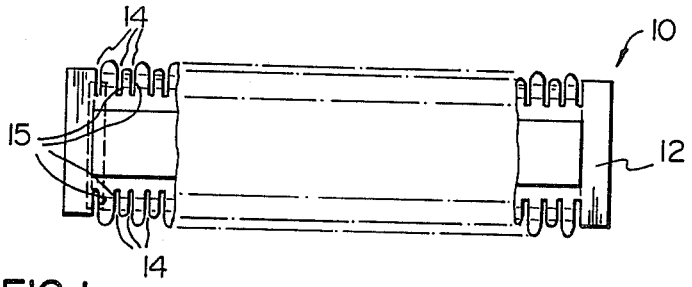
FIG. 1 PRIOR ART
FIG. 1 is a plan view of a cross-connect connector.

As shown in FIG. 1, a cross-connect connector 10 comprises a substantially planar strip 12 of dielectric material having along each edge a row of terminals 14. In this known connector structure, each of the terminals comprises two opposed electrically conductive portions (not shown) arranged on either side of a molded groove 15 in an edge of the strip 12. These conductor portions act to cut into insulating material surrounding a conductor when the conductor is forced into the groove so that the conductor portions electrically contact the conductor.

As is exemplified by the embodiment of the invention to be described, apparatus is provided for electrically connecting a group of conductors along one of the rows of terminals 14 thereby eliminating the need for manual assembly of conductors to the connector.

The apparatus for connecting the conductors to cross-connect connectors 10 comprises a supply for insulated conductors 16 (FIG. 2) this supply comprising a plurality of storage reels (not shown) to deliver the conductors between two guide rollers 18 which form part of a guiding and feeding means of the apparatus. From the guide rollers, the conductors 16 move along passlines and through a clamping means 20 of the guiding and feeding means, before proceeding through an assembly station 22 for conductors and connectors and then downstream from the station 22. This downstream movement is performed by a clamping means 24 which is also part of the guiding and feeding means. The clamping means 24 is movable between upstream and downstream positions, as will be described, to move lengths of conductor downstream from the station 22 and to hold these lengths securely in position while they are electrically connected and assembled to connectors and are severed from the supplies of conductors extending upstream from the assembly station. The apparatus also comprises a connector loading device shown generally at 26 in FIGS. 2 and 7.

The apparatus will now be described in greater detail. As shown by FIG. 2 and in greater detail by FIG. 6, the clamping means 20 lies in a fixed position upstream from the assembly station 22. The clamping means 20 comprises a stationary support block 28 which is secured to a frame 29 of the apparatus. As is clear from FIG. 6 and FIG. 9, clamping means 20 comprises a movable clamping member 30 having side arms 31 each pivoted at an intermediate position 32 to the support block 28. A transverse clamping bar 34 extending between the arms 31, moves up and down upon pivoting action of the clamping member about its pivotal position. The clamping member 30 is controlled in its pivotal movement by a pneumatic operated piston and cylinder assembly 36 which is connected to an upstream end of the member 30 by an actuating rod 38. The guiding and feeding means also comprises a conductor guide 40 disposed between the clamping means 20 and a severing means 42 for conductors. The severing means will be described below.

The guide 40 is mounted by a slide means comprising two laterally spaced-apart guide shafts 44 which are slidably received within the block 28 (FIGS. 6 and 9). A compression spring 46, engaging the upstream end of each shaft 44 within the block 28, is held between its associated shaft 44 and an abutment member 48 which extends laterally across the passlines slightly upstream from the block 28. The springs 46 form a spring biasing means to urge the conductor guide into a normal or downstream position shown in full outline in FIG. 6 in which it lies closely adjacent to, but slightly upstream from, the assembly station. The conductor guide is movable from its normal position and against the springs to a retracted or upstream position shown in chain-dotted outline also in FIG. 6. Conductor guide 40 has upwardly extending projections 50 which act as guides for the passage of the conductors between the projections and hold the conductors in their spaced-apart relationship.

The clamping means 24 (FIG. 2) has two mutually opposed clamping jaws 52 which are movable together in opening or closing directions. These jaws and their means of operation may be of any suitable construction. For instance, the jaws may be of an articulated structure operated from a single pneumatic operated cylinder (not shown) or each jaw, as shown in FIG. 2, may be moved by means of its own piston and cylinder assembly 54. Clamping jaws 52 and their assemblies 54 are mounted upon a support structure 56 which is slidably mounted upon two guide shafts 58 extending in the direction of the feedpaths of the conductors. The support structure 56 is movable along the guide shafts 58 by any suitable means, for instance by a piston and cylinder assembly 60 which is secured to the frame of the apparatus. Movement of the support structure 56 carries the clamping means 24 between a downstream position as shown in FIG. 2 and an upstream position as will be discussed. The downstream position is sufficiently far downstream from the assembly station to provide the required conductor lengths to be assembled to the connectors. The upstream position is upstream of the assembly station 22 and during movement into this position, the clamping jaws cooperate with the conductor guide 40 to urge it into its retracted position as will now be described. The various piston and cylinder assemblies which have been and are to be discussed operate in a certain rigid sequence, controlled electrically by microprocessor, to cause the apparatus to operate in the required fashion. The operation of the guiding and feeding means will now be discussed before describing the other operational parts of the apparatus.

Figures 22, 23, 24:
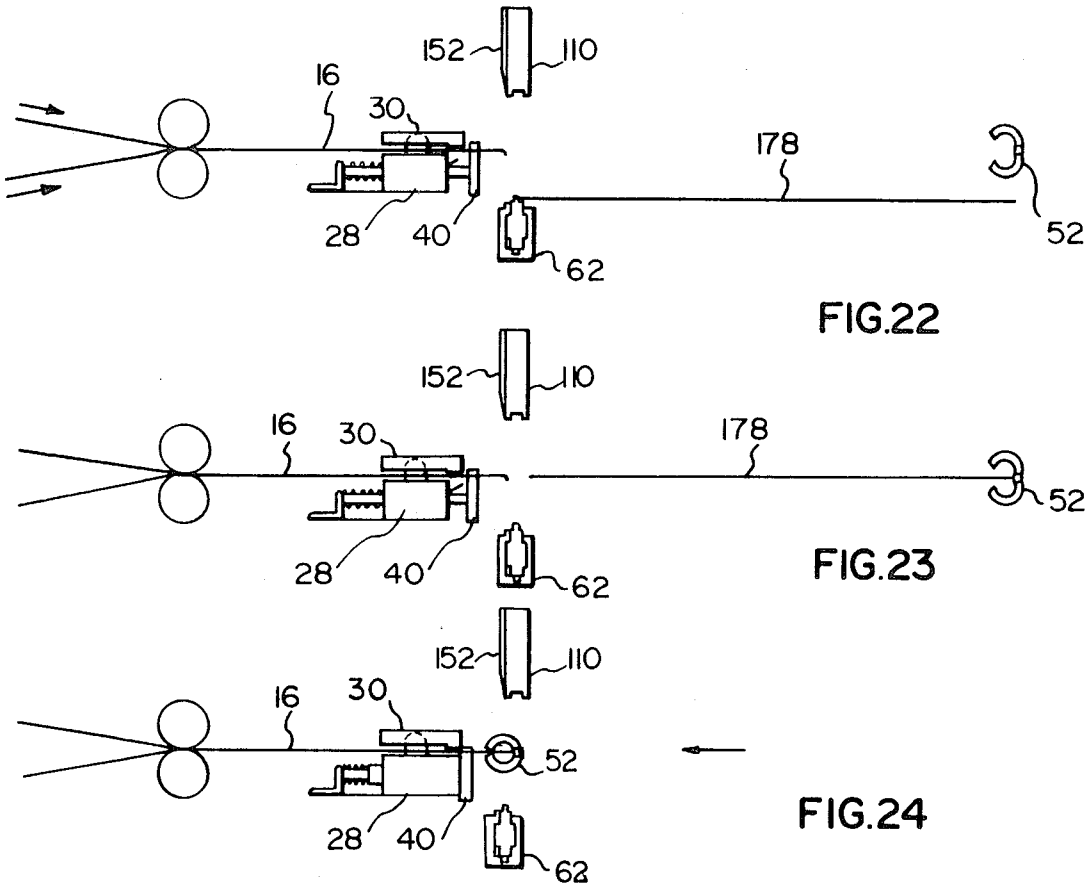
Figures 25, 26, 27, 28:
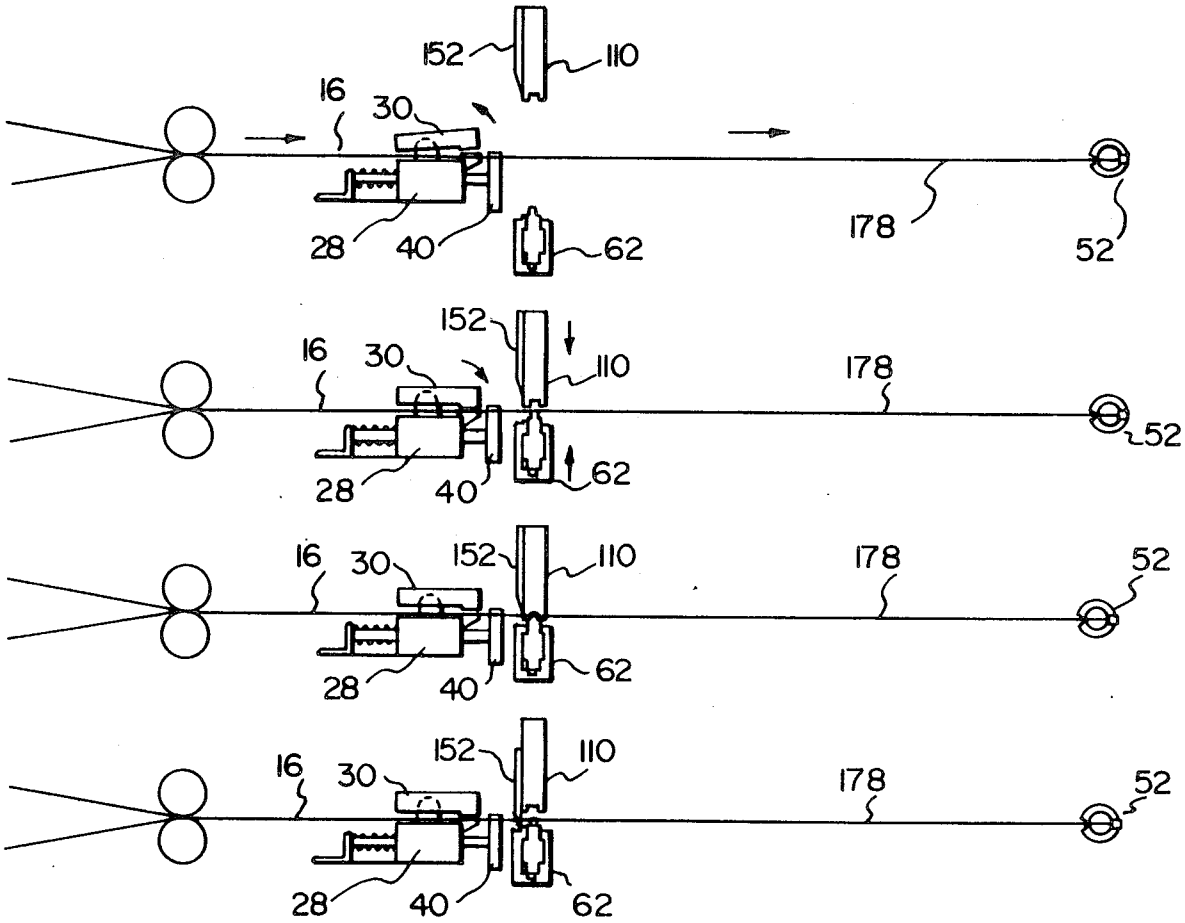

At commencement of operation of the guiding and feeding means for connecting the conductors to a connector, the clamping means 20 is in its clamping position as shown in FIGS. 2 and 22 with the clamping bar 34 gripping the conductors 16. Also, the clamping means 24 is in the downstream position with the jaws 52 open as shown particularly by FIG. 22 with the conductor guide 40 lying in its normal full outline position as in FIG. 6. The normal position of guide 40 is also shown by FIG. 22. The clamping means 24 is operated to move the jaws 52 towards the upstream position and as the jaws approach the upstream position they engage the opposing face of the guide 40 and move the guide to its retracted position as shown in chain-dotted outline in FIG. 6. The piston and cylinder assemblies 54 are then operated to close the jaws 52. This position of the guiding and feeding means is shown in FIG. 24. The piston and cylinder assembly 36 is then operated to raise the clamp bar 34 after which the closed jaws 52 are returned downstream to their downstream position (FIG. 25). This also allows the conductor guide 40 to return to its normal position. Before return of the clamping jaws 52 to their upstream positions, the clamping means 20 is returned to its closed condition and the jaws 52 are again opened thus giving the position shown in FIG. 22.

The connector loading device 26 which is shown in FIGS. 2 and 7 is more clearly shown in FIGS. 3, 4 and 5. The loading device comprises a means for holding a connector in the assembly station and for moving it between the assembly station and a withdrawn position. The connector holding means comprises a substantially U-shaped support 62 which, as shown in the Figures, comprises a base 64 for supporting one edge of a connector. The support 62 also has two vertical sides 66 for slidably contacting the side surfaces of the connector with the general plane of the connector extending vertically to provide one of the rows of terminals facing upwardly from and beyond the support 62. The location of the support 62 in the assembly station is as shown for instance in FIGS. 2, 6 and 26 to 28. The withdrawn position is shown for instance in FIGS. 3, 4 and 22 to 25.

The connector loading device includes a connector stacking means 68 (see FIGS. 2, 3, 4, 5 and 7). This stacking means is a vertical column which enables a plurality of connectors to be stacked one above another with the connectors lying in substantially horizontal planes, i.e. at right angles to the position they assume when in the support 62. A delivery means for the connectors to move them in succession from the vertical stacking column into the support 62 is shown in FIGS. 3, 4 and 5. This delivery means comprises a Push rod 70 operated by a piston and cylinder 72 to urge the lowest connector in the vertical stacking column outwards from the column and into a support 74 of similar structure to the support 62. The support 74 is mounted on an arm 76 with the support and arm pivoted about axis 78. A piston and cylinder assembly 82 attached to the arm, controls pivotal movement of the support and arm about axis 78. The sequence of operation for delivery of connectors into the support 62 only commences when the support lies in the withdrawn position. With the support 74 lying in the horizontal position indicated by FIG. 3, the push rod 70 is moved towards the left to force the lowest connector from the stacking column 68 and into the support 74. This support is then pivoted into a vertical position (shown with the arm 76 in chain-dotted outline in FIG. 3) by operation of the piston and cylinder assembly 82. In this position, the support 74 (shown in full outline in FIG. 5) is aligned with an intermediate support 84 which lies between the support 74 and the support 62. A connector 10 held in the support 74 is moved by operation of a further push rod 86 into the support 84, and under control of a piston and cylinder assembly 88. This movement causes a preceding connector as will be described, to be moved from the support 84 into support 62. As shown by FIG. 4, a tray 90 at the side of the apparatus is provided for collecting connector and conductor assemblies.

The connector loading device also comprises means for moving the support 62 between the assembly station and its withdrawn position. This moving means comprises a piston and cylinder assembly 90 (FIG. 7) which is disposed beneath a horizontal carrier 92 for the support 62 and moves the carrier 92 along horizontally spaced and vertically disposed main guide shafts 94 of the apparatus. These main guide shafts are securely mounted into the frame of the apparatus and are held for instance by an upper horizontal frame member 96 which in turn is carried by vertical frame members 98 (FIG. 2).

In the assembly station is disposed a means for inserting the conductors between opposed electrically conductive portions of the terminals thereby permitting electrical contact with the conductors. In this station the severing means 42 is provided to sever lengths of the conductors extending downstream from the assembly station from supplies of conductors extending upstream from the assembly station. The insertion and severing means jointly comprise a main horizontal support 100 (see FIGS. 8 to 12 and 19). This support has two depending short sections 102 by which it is slidably carried upon the main guide shafts 94. Extending between and across the support sections 102 is an insertion tool carrier 104. The insertion tool carrier comprises two parts, namely a C-shaped upstream part 106 and a downstream part or cover plate 108 (see FIGS. 6, 18 and 19). A plurality of conductor insertion tools 110 are carried by the insertion tool carrier. Each insertion tool 110 has a shaft 112 of rectangular section and at its lower end, each insertion tool has the conventional structure 114 (see particularly FIG. 19) for inserting conductors into the terminals of a cross-connect connector. As shown by the Figures (see also FIGS. 8, 11, 12, 19, 20 and 21) the insertion tools are located in side-by-side relationship with the shafts 112 slidable upon each other and guided between the C-shaped part 106 and cover plate 108 of the carrier 104. To allow for the insertion of the tools 110, the cover plate 108 is provided with a relieved section 116 along the part of its length corresponding to the positions of the tools 110 (see FIG. 19). The carrier 104 is mounted by means of the C-shaped section 106 within two reverse C-shaped housings 117 (FIG. 6) which are screwed respectively, one to each of the support sections 102 as shown also by FIG. 8 onwards. For reasons to be discussed below, the C-shaped part 106 is slidable within the housings 117. The horizontal support 100 is vertically movable between the assembly station, for instance as shown in FIG. 8, and a withdrawn position vertically above it, for instance as shown in FIGS. 22 to 25. This movement, which is along the main guide shafts 94, is effected by a control rod 118 operated by a piston and cylinder assembly 120 vertically mounted upon the horizontal frame member 96.

An insertion tool operating means is provided for causing sliding movement of the tools towards and away from the connector holding means, i.e. support 62, the movement being in sequence along the tools from end-to-end of the tool assembly. This operating means comprises an operating shaft 122 which is slidably received within the C-shaped section 106 and is held in place by the cover plate 118 (see FIGS. 6, 18 and 19). The shaft 122 is movable by a horizontally disposed piston and cylinder assembly 124 secured to the main horizontal support 100. A piston rod 126 of the assembly 124 is connected to one end of the shaft 122 over which it extends, by a connecting block 128, for instance as shown in FIG. 8. The operating shaft 122 and the tools 110 are operably connected together by a cam and cam follower means to effect the vertical sliding movement of the insertion tools. The cam and cam follower means comprises a cam slot 130 (see FIGS. 13, 18 and 19) which extends longitudinally of the operating shaft 122 except for a longitudinally short outward and return section 132 (FIG. 13) of the slot and which extends downwards and laterally of the slot 130 for a short distance. In respect of each of the insertion tools 110, the cam and cam follower means also comprises a rotatable cam follower roller 134 (FIG. 19) which is rotatably mounted upon one side of each of the shafts 112 so as to lie within the slot 130 in engagement with both of its side surfaces during movement of the operating shaft in either direction. As can be seen, movement of the operating shaft 122 in either horizontal direction by means of the piston and cylinder assembly 124 causes the rollers 134, in turn, to move along the outward and return section 132 of the slot 130. Such movement as is indicated by FIGS. 13, 20 and 21, effect the downward movement of the insertion tools towards the support 62, followed by the return or upward movement.

As may be seen from inspection of the various Figures, the insertion structures 114 of the insertion tools 110 are positioned a distance apart which is exactly double that of the distance apart of the terminals along a row of terminals of a connector. The reason for this is that the terminals are so close together that no practical way has yet been found of assembling and designing the structures 114 with their distances apart equaling that of the distances apart of the terminals while still being able to operate the insertion tools properly during the insertion procedure. Hence, each movement of the operating shaft 122 in operating the insertion tools 110 will only urge those tools into engagement with alternate conductors of a group extending across the terminals. Thus the remainder of the conductors are not connected to the terminals during one direction of movement of the operating shaft 122. To overcome this problem, a tool position shift means 136 (see FIG. 8) is provided to move the tool insertion carrier 104 within the housings 117 for a distance equal to the distance apart of the terminals in the row on a connector. Hence one direction of movement of the operating shaft 122 will connect alternate conductors of the group along the row of terminals, as has just been indicated, while the return movement of the operating shaft will connect the remaining terminals as will now be described.

The tool position shift means 136 comprises a thrust means in the form of an inclined rib 138 having parallel side surfaces 140 (FIG. 8), the rib extending outwardly from an elongate plate 142. The plate 142 extends downwardly of one of the support sections 102 and lies between that section and the C-shaped section 106 of the tool carrier 104. To allow for this positioning of the plate, the section 106 is provided with a complementary groove 144 (see FIG. 10) with the rib 138 extending completely along the groove from one end to the other. The rib is received with its side surfaces 140 in sliding and continuous engagement with the side surfaces of the groove as shown by FIG. 10. Vertical movement of the plate 142 will cause the rib 138 to translate that movement into a horizontal movement of the C-shaped section 106 and the cover plate 108 in the appropriate direction while the shaft 122 will remain stationary. The plate 142 is movable in the vertical direction by operating means which is a piston and cylinder assembly 146 which is secured in a vertical position to the upper side of the main horizontal support 100. To control the horizontal movement in either direction of the tool carrier 40, the cover plate 108 is flanked at each end with an abutment plate 148. Each abutment plate 148 has a vertical end abutment surface 150 for engagement with an adjacent housing 117 upon movement of the tool carrier in the appropriate direction. The degree of movement permitted is of course that required to move the tool carrier together with the insertion tools 110 for a distance corresponding to half the distance between corresponding locations on adjacent tools. In other words, the degree of movement in either direction is half the distance between adjacent structures 114 of the tools.

Operation of the piston and cylinder assemblies 124 and 146 is controllable to effect the following operation of the insertion tools 110. At commencement of an insertion operation, the plate 142 lies at its downward position (FIG. 8) so that the rib 138 has moved the insertion tool carrier 104 towards the right whereby the abutment 150 of plate 148 on the right-hand side abuts the housing 117 at that side. In this position, the operating shaft 122 lies towards its right-hand extreme limit shown by FIG. 8 with the outward and return section 132 of slot 130 lying to the right-hand side of the group of insertion tools 110 (the section 132 of the slot is shown in FIG. 8). The assembly 124 is then operated to move the operating shaft 122 towards the left. This movement causes the first of the insertion structures 114 to insert a conductor 16 into the first terminal at the right-hand end of the row of terminals on a connector 10 in the assembly station. This is shown by FIG. 8. Continued movement of the shaft 122 in the same direction then connects the alternate conductors to the appropriate terminals whereby conductors are connected to the odd numbered terminals counted from the right-hand side. Thus as can be seen by viewing the right-hand end of FIG. 8, and also FIG. 20, the extreme left-hand structure 114 is aligned with the conductor for the forty-ninth terminal and will proceed to insert the conductor in that terminal when the insertion tool 110 is moved downwards by its follower roller 134 proceeding along the section 132 of the slot 130.

Upon the shaft 122 reaching the extreme of movement on the left-hand side, the assembly 146 operates to raise the plate 142. The difference in the plate positions is seen by comparing FIG. 8 with FIG. 12. This movement takes place until the abutment surface 150 of the left-hand side abutment plate 148 contacts its associated housing 117. The positional difference of the abutment plates which indicates the sideways shift of the carrier 104 may also be seen by comparing FIG. 8 with FIG. 12. This lateral movement of the tool carrier 104 causes the tools 110 and thus the structures 114 to move by a spacing equivalent to the distance apart of the row of terminals in the connector. Hence instead of the left-hand structure being aligned with terminal forty-nine as shown in FIG. 8 (as measured from the right-hand side of the connector 10), this structure 114 is now aligned with the fiftieth or left-hand end terminal as shown by FIG. 12. This is also clear from a comparison of FIGS. 20 and 21. Of course the other structures 114 have also moved by one terminal spacing towards the left in conjunction with the movement of the left-hand structure 114. It follows that upon return movement of the operating shaft 122 towards the right by operation of the assembly 124, then the structures 114 move downwardly to insert the conductors into the even numbered terminals as measured from the right-hand side of the connector and commences with the fiftieth terminal which is on the left-hand end. The conductors which were not inserted into the terminals during the movement to the left of the operating shaft, are now being connected into the terminals.

The severing means 42 is of such a construction as to enable it to be moved between a cutting position and a non-cutting position. As shown for instance by FIGS. 8, 12, 18 and 19, the severing means comprises a cutting blade 152 which is secured to an arm 154 and the arm is pivoted at one end, i.e. the right-hand end in the Figures, to the lower end of a downwards projection 156 of the operating shaft 122. This pivotal connection is shown in detail in FIG. 19. Thus as the operating shaft 122 moves horizontally, it carries the arm 154 and blade 152 with it. The position of the blade 152 is such that its cutting edge is always slightly to the left of the mid position of the return section 132 of the slot 130 (see FIGS. 8 and 13) to enable the insertion tools 110 to insert conductors before a cutting stroke takes place, as will be described.

Figure 14:
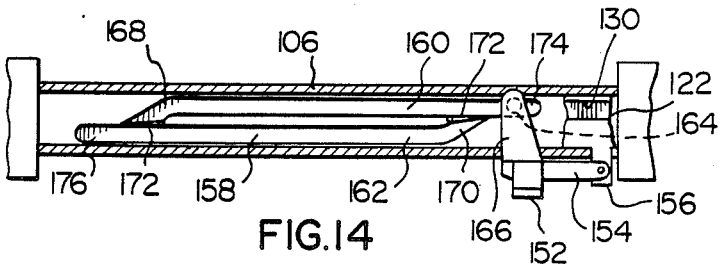
Figure 15:
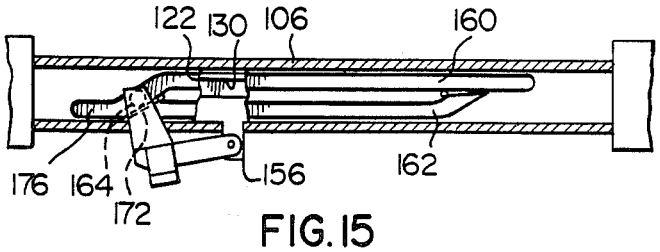
Figure 16:
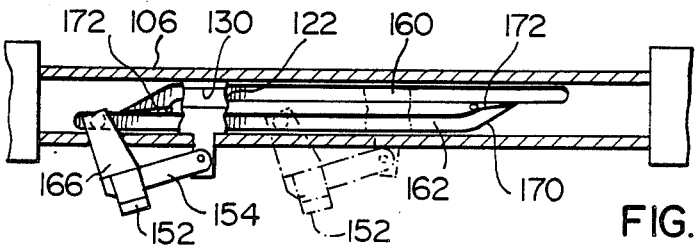
Figure 17:
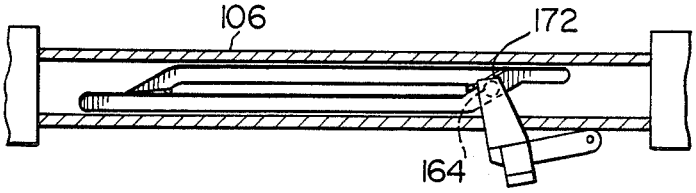

Means is provided to move the cutting blade into and out of its cutting position and to hold it both in the cutting position and in the non-cutting position, this moving means comprises a cam and cam follower means which is illustrated in FIGS. 14 to 17. As shown in those Figures, a cam slot 158 is formed in the inwardly facing surface of the base of the C-shaped section 106 of the insertion tool carrier. This slot has two parallel horizontal sections 160 and 162 which extend along sufficient distance of the section 106 to accommodate the horizontal movement of the blade upon operation of the shaft 122 while also controlling the position of the blade. A cam follower roller 164 is received in the cam slot and is rotatably mounted upon a cam follower arm 166 the lower end of which is secured to the left-hand end of the arm 154 (FIGS. 12 and 18). The arm 166 is vertically movable in a slot 167 formed in the shaft 122 (FIG. 18). It follows that when the roller 164 lies in the upper slot section 160, then the arm 154 is held in an upward pivoted position (for instance as shown in FIG. 14) so that the cutting blade 152 lies in a non-cutting position which is disposed above the terminals in a connector. This relationship of the cutting blade to the terminals is illustrated in FIG. 20. On the other hand with the roller 164 lying in the lower section 162, the cutting blade is in its cutting position with the arm 154 pivoted downwards (for instance as shown in FIG. 16). In this position, as shown by FIG. 21, the cutting blade extends across the line of the terminals so as to perform a cutting operation as the cutting blade is moved from left to right in the drawings.

The two slot sections 160 and 162 are interconnected at their ends by inclined slot portions 168 and 170. Non-return devices are provided at the entrance of the slot 168 into the section 162 and also at the entrance of the slot portion 170 into the section 160. Each non-return device comprises a gate 172 which is pivoted at one end and normally lies in a position as shown by FIG. 14 in which the gate does not obstruct either of the sections 160 or 162 but, in fact, acts as part of a surface of the slot section. Each gate is spring urged into this position in which it closes the slot portion 168 or 170, as the case may be. By pressure exerted upon it by the roller 164 moving along a slot portion 168 or 170, a gate is pivoted into an open position in which it allows the roller to move from one slot section, along the associated slot portion and into the other slot section. The slot section 160 has a short end section 174 which extends to the right slightly beyond the gate 172 to accommodate the roller 164 and allow for return of the gate 172 into its closed position. Similarly the slot section 162 has an end section 176 at its left-hand end which is in corresponding relationship to the associated gate 172.

The complete operation of the severing means is as follows. With the operating shaft 122 at its right-hand end of movement as shown in FIG. 8, the arm 154 lies in its upward pivoted position with the blade in its non-cutting position. This corresponds to the position of the severing means in FIG. 14 with the roller 164 at the right-hand end of the slot section 160 and lying in the end section 174. As the shaft 122 moves towards the left it causes the severing means to move along the slot section 160, because of the drive imparted to it by its connection to the projection 156 on the operating shaft. As the right-hand gate 172 is in its closed position, the roller 164 will roll over the gate and proceed along the slot section 160 without difficulty. When the roller 164 reaches the left-hand end of slot section 160, it proceeds to move along the slot portion 168 and, upon contact with the gate 172 at that end, forces the gate open as shown in FIG. 15. Further movement of the shaft 122 then carries the severing means to its left-hand limit with the roller 164 lying in the slot end section 176. As the roller is now disengaged from the adjacent gate 172, this gate is allowed to return to its closed position as shown in FIG. 16. In this position of the roller 164, the arm 154 has been pivoted downwards so that the blade lies in its cutting position. The operating shaft 122 then proceeds towards the right-hand side on its return movement. This is accompanied by movement of the roller 164 along slot section 162 (see chain-dotted outline in FIG. 16) to cause a cutting movement of the cutting blade across the terminals of the connector. Upon reaching the right-hand end of the section 162, the roller moves up the inclined slot portion 170 and forces open the adjacent gate 172 (FIG. 17) thereby returning to its position as shown in FIG. 14. In this position, the gate 172 is allowed to close and the cutter has completed one cycle.

The complete operation of the machine is as follows.

At the end of one operation, conductor lengths 178 have been connected at their upstream ends into terminals of a connector 10 held by holder 62. At this stage as shown in FIG. 22, the connector and conductor assembly lie in the withdrawn position with the support 62 withdrawn downwardly from the assembly station. Also in this position, the conductor guide 40 lies in its normal or downstream position adjacent the assembly station with ends of the conductors 16 from the conductor supplies extending between guide projections 50. The clamping means 20 is closed and the clamping means 24 is open to allow the gripped downstream ends of conductor lengths 178 to move out of the jaws 52 during movement of the holder into the withdrawn position. The horizontal support 100 carrying the insertion tools and severing means is in its withdrawn or upper position.

To commence a new cycle for inserting a succeeding connector into the assembly station for inserting conductors into it, the connector loading device 26 is then actuated. The push rod 70 moves towards the left (FIG. 3) to urge the lowermost connector in the stacking column 68 into the support 74 which lies in a horizontal position as shown in FIG. 3. The assembly 82 is then operated to swing the support 74 into the vertical position, as has been described and this movement is followed by operation of the push rod 86 (FIG. 5) to urge the connector in the support 74 across and into the intermediate support 84. This movement causes the connector moving into the support 84 to push a preceding connector 10 lying on that support into the support 62 thereby pushing the previous connector with the conductors 178 attached out from the support 62 and into the collection tray 91. The connector and conductor assembly being removed is shown with the connector in chain-dotted outline in FIG. 4. The support 74 is then returned into its horizontal position shown in FIG. 3. After removal of the finished connector and conductor assembly and insertion of the connector 10 from support 84 into support 62, the situation is as shown in FIG. 23.

The guiding and feeding means then operate. The open jaws 52 are moved upstream, as has previously been described, to their upstream position and during this movement urge the guide 40 into its retracted position. This is as shown in FIG. 24. This movement of the guide 40 causes the leading ends of the conductors 16 to extend further from the guide thereby enabling these leading ends to be gripped tightly by the jaws 52 when the jaws close as shown in FIG. 24. Movement of the conductors up to this stage is prevented because the clamping means 20 is closed. The clamping means 20 is then opened thereby releasing the conductors following which the clamping means 24 is returned to its downstream position, as shown in FIG. 25, thereby drawing the conductors downstream to provide new lengths 178 of conductor extending from the guide 40 to the clamping means 24. Downstream movement of clamping means 24 allows the guide to return to its normal position. Clamping means 20 is then closed so that the conductors are gripped by both clamping means.

The horizontal support 100 is then lowered to bring the insertion tools 110 into the operating or lower position together with the severing means. Also, the support 62 is raised into the assembly station. This is the position of the apparatus shown in FIG. 8 with the insertion tools disposed slightly above the upper terminals of the connector held in the assembly station. In this position, the insertion tool carrier lies towards its right-hand side with the abutment surface 150 of the right-hand abutment plate 148 abutting the adjacent housing 117. Hence the insertion tools are aligned with the odd numbered terminals commencing from the right-hand side in FIG. 8.

With the clamping means 20 in the closed position and with the parts of the apparatus in the position shown in FIG. 27, the insertion of the upstream ends of the conductor lengths 178 into the row of terminals and the severing operation then commences. Movement of the operating shaft 122 causes the insertion tools 110 to move downwardly in sequence as described by virtue of the reception of the cam follower rollers 134 in the cam slot 130. Simultaneously with this, the operating shaft 122 moves the severing blade 152 across and above the row of terminals, i.e. in its non-cutting position, by the reception of the roller 164 in the slot section 160. As shown by FIG. 20, the odd numbered conductor lengths 178 are moved into the terminal while the even numbered conductors are not affected by the right to left movement of the shaft 122. As described above the roller 164 then moves downwardly into the slot end section 176 to drop the cutting blade into its cutting position. This is the position of the apparatus shown by FIG. 11. At this stage, the shaft 122 has moved to the limit in the left direction of movement. The plate 142 is then raised from the position shown in FIG. 11 to that of FIG. 12 which immediately causes the tool carrier 104 to move towards the left until the abutment surface 150 of the left side abutment plate 148 contacts the associated housing 117. This position is shown by FIG. 12 in which the insertion tools have also been moved towards the left so that they are then aligned vertically above the even numbered terminals as counted from the right-hand end. A comparison of FIGS. 11 and 12 and FIGS. 20 and 21 will show these differences. The shaft 122 then moves towards the right so that the conductors which have not been connected to the terminals on the previous shaft movement are now forced into their associated terminals. As shown by FIG. 21, the position of the cam slot 130 is such that a tool 110 is shown at its lowest position inserting two conductor into evenly numbered terminals whereas an immediately adjacent right-hand tool 110 is just commencing its insertion stroke and can be seen commencing to force two conductors into the terminals. As the shaft 122 proceeds to the right the cutting blade 152 trails slightly behind the vertical movement of the insertion tools 110 on the return stroke of the shaft. Thus, upon the cutting blade reaching each particular conductor, that conductor is already lying firmly held within its particular terminal and the cutter severs each length of conductor 178 from the supply conductors 16. The connector held in the holder 62 then has all its conductor lengths assembled to it. Upon the shaft 122 reaching its right-hand position illustrated by FIG. 8, i.e. after its return stroke, then the assembly 146 is operated to move the plate 142 downwards to return the carrier 104 to the initial position towards the right as shown in FIG. 8. This is preparatory to insertion of conductors into the next succeeding connector which is to be inserted into the support 62.

The piston and cylinder assembly 90 then operates to return the support 62 to its withdrawn position so as to complete the cycle. The whole cycle is then repeated to assemble conductors into a succeeding connector and the just completed assembly is ejected into the tray 91.

It should be realized that the steps discussed above may in some cases not be followed rigidly in the order which has been discussed as some change in parts of the procedure may be effected without changing the eventual product. For instance, the support 62 may be located in the assembly station either at the same time as or in sequence with the movement of the main horizontal support 100 to perform the insertion operation. Obviously, to perform the whole operation in the quickest time, it is preferable to move both of the supports 62 and 100 towards the assembly station simultaneously. Further to this, after the conductors have been inserted into the terminals and severed, the return movement of the insertion tool carrier 104 towards the right may take place either as described or at some other time while ensuring that the insertion tool carrier is in the correct position when required for the next succeeding insertion operation.

The use of the apparatus and method according to the invention substantially increases the quantities of assembled conductors and connectors for a given time. For instance, when performed manually it has been shown that about one hundred connectors may be connected to fifty conductor lengths in a two workday period by one operator. With the machine according to the invention it is possible to connect conductors to at least 1500 connectors during the same period.

What is claimed is:

1. Apparatus for electrically connecting a group of insulated conductors along a row of terminals of a cross-connect connector, said apparatus having an assembly station and comprising:

means disposed at one side of the assembly station for holding the connector in the assembly station;

an insertion tool carrier located at the other side of the assembly station;

a plurality of conductor insertion tools mounted in a planar group and in slidable side-by-side relationship within the insertion tool carrier for sliding movement towards and away from the holding means; and insertion tool operating means comprising an operating shaft reciprocally movable in the direction of the plane of the planar group transversely of the direction of sliding movement of the tools, said shaft connected to the tools to cause the tools to slide relative to one another and in sequence towards and away from the holding means.

2. Apparatus according to claim 1 wherein the shaft and the tools are operably connected together by a cam and cam follower means to cause the sliding movement.

3. Apparatus acccording to claim 2 wherein the shaft is formed with a longitudinally extending cam slot having a laterally extending outward and return section and each tool has a cam follower mounted thereon, reciprocable movement of the shaft effecting relative movement of each cam follower and the slot and causing the sliding movement of the associated tool when the cam follower moves along the outward and return section of the slot.

4. Apparatus according to claim 3 provided with a severing means associted with the insertion tool carrier and operably movable to sever lengths of conductor electrically connected to the row of terminals form supplies of conductor, and means for moving the severing means, relative to the insertion tool carrier, on a cutting stroke and transversey across the conductors of the groups.

5. Apparatus according to claim 3 further comprising a tool position shift means to move the tool insertion carier and thus the plurality of tools between first and second positions laterally of the direction of sliding movement of the tools, said positions spaced apart half of the distance between corresponding locations on adjacent tools, and said shift means operable to move the carrier after movement of the reciprocable shaft in each direction whereby the shaft is movable in one direction to electrically connect alternate conductors along the row of terminals with the tool carrier in said first position and, after movement of the carrier into said second position, the shaft is movable in the opposite direction to electrically connect the other conductors along the row of terminals.

6. Apparatus according to claim 5 wherein the tool position shift means comprises a thrust means operable against the carrier to produce alternate directions of movement and an operating means actuable after each direction of movement of the shaft to relatively move the thrust means to produce carrier movement in an appropriate direction.

7. Apparatus according to claim 6 provided with a severing means operable to sever lengts of conductor electrically connected to the row of terminals from supplies of conductor, the severing means reciprocally movable transversely of the direction of sliding movement of the tools as the shaft moves on its reciprocating movement with the severing means movable between a cutting position and a non-cutting position and having means:

(a) to move the severing means and hold it in the non-cutting position during its movement together with the shaft in said one direction; and (b) to move the severing means and hold it in the cutting position during its movement together with the shaft in said opposite direction with the severing means passing the insertion tools in said opposite direction after the insertion tools have completed their movement towards the holding means.

8. Apparatus according to claim 7 wherein the severing means is pivotally movable between its cutting and non-cutting positions and the moving means comprises a further cam and cam follower means.

9. Apparatus according to claim 8 wherein the severing means is reciprocally movable relative to the insertion tool carrier with the further cam and follower means operably connecting the severing means and the insertion tool carrier.

10. Apparatus according to claim 9 wherein the cam comprises a cam slot in the tool carrier with the follower received within the slot and the slot has two slot sections extending in the direction of reciprocating movement of the severing means; location of the follower in one slot section holding the severing means in the cutting position and location of the follower in the other slot section holding the severing means in the non-cutting position, the slot sections being interconnected at their ends to move the follower from slot section to slot section, and the cam having non-return devices to ensure the follower is movable only in a single direction from slot section to slot section.

11. Apparatus according to claim 10 wherein each non-return device comprises a pivotal gate which is normally spring urged to close part of the cam slot for preventing movement of the follower in the opposite direction to the single direction and is pivotally movable by pressure of the follower during follower movement in said single direction to allow the follower to move from slot section to slot section in said single direction.

* * * * *